US006412254B1

(12) United States Patent
Tilman et al.

(10) Patent No.: US 6,412,254 B1
(45) Date of Patent: Jul. 2, 2002

(54) RESEALABLE PACKAGE HAVING SLIDER DEVICE, TAMPER-EVIDENT STRUCTURE, AND METHODS OF MANUFACTURING

(75) Inventors: Paul A. Tilman, Sherwood; James E. Buchman, Hortonville, both of WI (US)

(73) Assignee: Reynolds Consumer Products Inc., Richmond, VA (US)

( * ) Notice: Subject to any disclaimer, the term of this patent is extended or adjusted under 35 U.S.C. 154(b) by 0 days.

(21) Appl. No.: 09/464,906

(22) Filed: Dec. 16, 1999

Related U.S. Application Data

(60) Provisional application No. 60/138,937, filed on Jun. 11, 1999.

(51) Int. Cl.[7] ..... B65B 61/18

(52) U.S. Cl. ..... 53/412; 53/450; 53/133.4; 53/139.2; 53/550; 493/213; 493/927

(58) Field of Search ..... 53/412, 416, 450, 53/133.4, 139.2, 550, 547; 383/64, 204, 209; 493/213, 214, 237, 927

(56) References Cited

U.S. PATENT DOCUMENTS

| | | | | |
|---|---|---|---|---|
| 3,246,444 A | | 4/1966 | Paisley | |
| 4,240,241 A | | 12/1980 | Sanborn, Jr. | |
| 4,241,865 A | | 12/1980 | Ferrell | |
| 4,246,288 A | | 1/1981 | Sanborn, Jr. | |
| 4,415,386 A | | 11/1983 | Ferrell et al. | |
| 4,437,293 A | | 3/1984 | Sanborn, Jr. | |
| 4,538,396 A | | 9/1985 | Nakamura | |
| 4,782,951 A | | 11/1988 | Griesbach et al. | |
| 4,786,190 A | | 11/1988 | Van Erden et al. | |
| 4,823,961 A | | 4/1989 | Griesbach et al. | |
| 4,876,842 A | | 10/1989 | Ausnit | |
| 4,927,271 A | | 5/1990 | Branson | |
| 5,005,707 A | | 4/1991 | Hustad et al. | |
| 5,014,856 A | | 5/1991 | Griesbach et al. | |
| 5,036,643 A | | 8/1991 | Bodolay | |
| 5,050,736 A | | 9/1991 | Griesbach et al. | |
| 5,247,781 A | | 9/1993 | Runge | |
| 5,425,825 A | | 6/1995 | Rasko et al. | |
| 5,431,760 A | | 7/1995 | Donovan | |
| 5,519,982 A | | 5/1996 | Herber et al. | |
| 5,713,669 A | * | 2/1998 | Thomas et al. | 383/204 |
| 5,733,636 A | | 3/1998 | May | |
| 5,871,281 A | | 2/1999 | Stolmeier et al. | |
| 5,893,645 A | | 4/1999 | May | |
| 5,956,924 A | | 9/1999 | Thiemann | |
| 6,286,189 B1 | * | 9/2000 | Provan et al. | |
| 6,138,439 A | * | 10/2000 | McMahon et al. | 53/412 |
| 6,178,722 B1 | * | 1/2001 | McMahon | 53/133.4 X |
| 6,257,763 B1 | * | 7/2001 | Stolmeier et al. | 383/64 X |

FOREIGN PATENT DOCUMENTS

| | | |
|---|---|---|
| EP | 0 978 450 A1 | 2/2000 |
| FR | 2 533 892 | 4/1984 |
| WO | WO 94/19250 | 9/1994 |
| WO | WO 98/05567 | 2/1998 |
| WO | WO 99/24325 | 5/1999 |

* cited by examiner

*Primary Examiner*—Stephen F. Gerrity
(74) *Attorney, Agent, or Firm*—Tracey C. Beiriger

(57) ABSTRACT

A method of manufacturing includes feeding a continuous web of flexible panel material into a package forming operation. The continuous web is configured to define first and second juxtaposed panel sections; positioning a continuous strip of resealable closure mechanism having a series of spaced slider devices thereon between the first and second panel sections of the continuous web to form a continuous combination having the first and second panel sections and the resealable closure mechanism; and forming a plurality of flexible packages from the continuous combination. Each flexible package includes only one slider device thereon and a seal between the first and second panel sections oriented to enclose the one slider device between the first and second panel sections and the seal. A system for manufacturing a flexible package is disclosed. In addition, a flexible package is disclosed.

10 Claims, 5 Drawing Sheets

RESEALABLE PACKAGE HAVING SLIDER DEVICE, TAMPER-EVIDENT STRUCTURE, AND METHODS OF MANUFACTURING

Claim to Priority Under 35 U.S.C. §119(e)

Priority under 35 U.S.C. §119(e) is requested to Provisional Application Serial No. 60/138,917, filed on Jun. 11, 1999, and entitled RECLOSABLE PACKAGE HAVING SLIDER DEVICE, TAMPER-EVIDENT STRUCTURE, AND METHODS OF MANUFACTURING. The complete disclosure of Provisional Application Serial No. 60/138,937 is incorporated by reference herein.

FIELD OF THE INVENTION

The present disclosure generally relates to resealable packages, such as plastic bags. In particular, the present disclosure relates to resealable packages manufactured from form, fill, and seal machines having slider devices with tamper-evident structures. This disclosure also contains methods applicable to resealable packages.

BACKGROUND

Resealable packages are used to store or enclose various types of articles and materials. These packages can be used to store a variety of products, for example food items and non-food consumer goods. Resealable packages are convenient because they can be closed and resealed after the initial opening to preserve the enclosed contents. In some instances, providing products in resealable packages appreciably enhances the marketability of those products.

Form, fill, and seal technology is known in the packaging industry as a method to package consumable goods. When consumable goods are not used completely, after the package is initially opened, a user relies on a resealable or zipper type closure mechanism to reseal the package and keep the remaining contents fresh.

Many resealable packages are opened and closed by a slider device that aids in the opening and closing of the resealable closure mechanism. Attaching the slider device to the resealable package is sometimes difficult and inefficient. Therefore, improvements are desirable.

SUMMARY OF THE DISCLOSURE

In one aspect of the present disclosure, an example embodiment involves a method of manufacturing a flexible package. The method includes feeding a continuous web of flexible panel material into a package forming operation, the continuous web is configured to define first and second juxtaposed panel sections; positioning a continuous strip of resealable closure mechanism having a series of spaced slider devices thereon between the first and second panel sections of the continuous web to form a continuous combination having the first and second panel sections and the resealable closure mechanism; and forming a plurality of flexible packages from the continuous combination. Each flexible package includes only one slider device thereon and a seal between the first and second panel sections oriented to enclose the one slider device between the first and second panel sections and the seal.

In another aspect of the present disclosure, an example embodiment involves a method of manufacturing a flexible package. The method includes feeding a continuous web of flexible panel material into a package forming operation, the continuous web being configured to define first and second juxtaposed panel sections; positioning a continuous strip of resealable closure mechanism having a series of spaced slider devices and notches thereon between the first and second panel sections of the continuous web to form a continuous combination having the first and second panel sections and the resealable closure mechanism; forming a plurality of flexible packages from the continuous combination. Each flexible package includes only one slider device thereon; seal between the first and second panel sections oriented to enclose the one slider device between the first and second panel sections and the seal; and one operably positioned notch.

In another aspect of the present invention, a system is provided for manufacturing a flexible package. The system includes a web feed and form assembly, a closure mechanism feed assembly, and a cutting and sealing assembly. The web feed and form assembly is configured to feed a continuous web of flexible panel material and to form first and second juxtaposed panel sections from the continuous web of flexible panel material. The closure mechanism feed assembly is configured to position a continuous strip of resealable closure mechanism having a series of spaced slider devices thereon between the first and second panel sections to form a continuous combination having the first and second panel sections and the resealable closure mechanism. The cutting and sealing assembly is configured to form a plurality of flexible packages from the continuous combination in such a manner that each flexible package includes only one slider device thereon and a seal between the first and second panel sections oriented to enclose the one slider device between the first and second panel sections and the seal.

A more complete appreciation of the present invention and its scope may be obtained from the accompanying drawings, which are briefly described below, from the following detailed descriptions of presently preferred embodiments of the invention and from the appended claims.

DETAILED DESCRIPTION

The principles described herein are applicable to a variety of packaging arrangements. The principles of the disclosure are particularly advantageous for manufacturing resealable packages. An appreciation of various aspects can be gained from the following discussion of an application example for such a packaging arrangement.

A. Overview of Package 10

Figure 1:
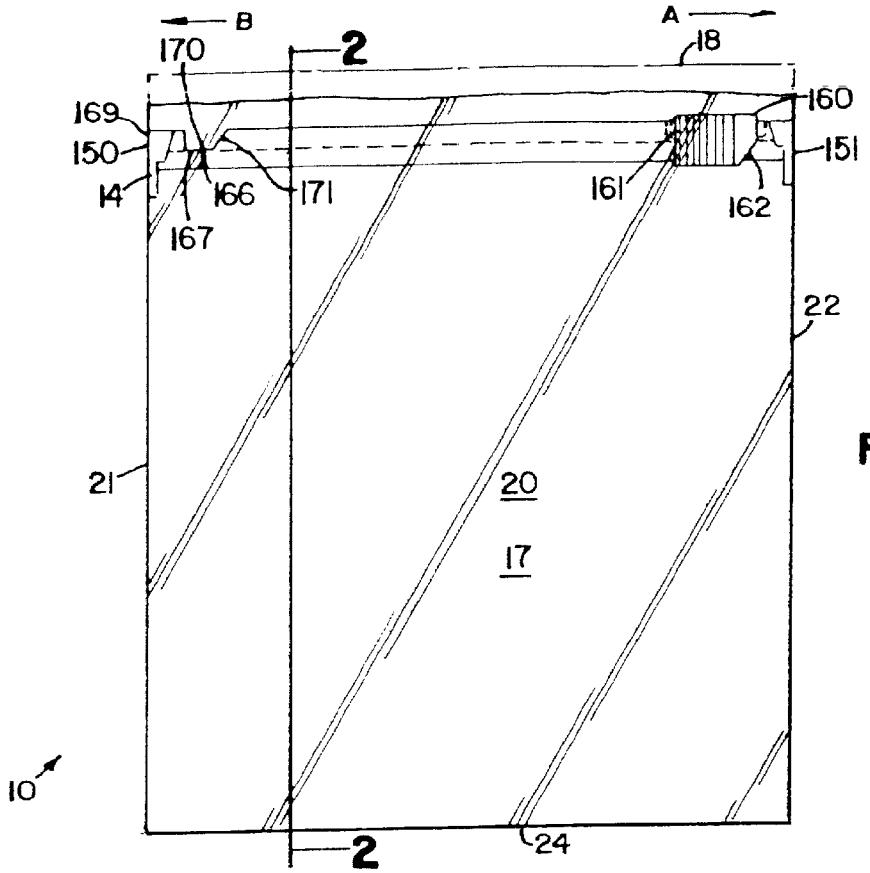
FIG. 1 is a schematic, plan view of an example embodiment of a resealable package having a slider device and a tamper-evident structure, according to selected principles of the present disclosure.

Attention is directed to FIG. 1. FIG. 1 is a schematic, plan view illustrating an example packaging or closure arrangement in the form of a resealable, flexible package 10, for example, a polymeric package such as a plastic bag, having a resealable closure mechanism 14 constructed in accordance with the present disclosure.

Typically, the resealable package 10 is manufactured from a flexible, polymeric, plastic film, such as low density polyethylene, commonly known. Alternatively, the package 10 can be made from multilayer laminates, metalized plastic, or other materials having some flexibility.

Figure 2:
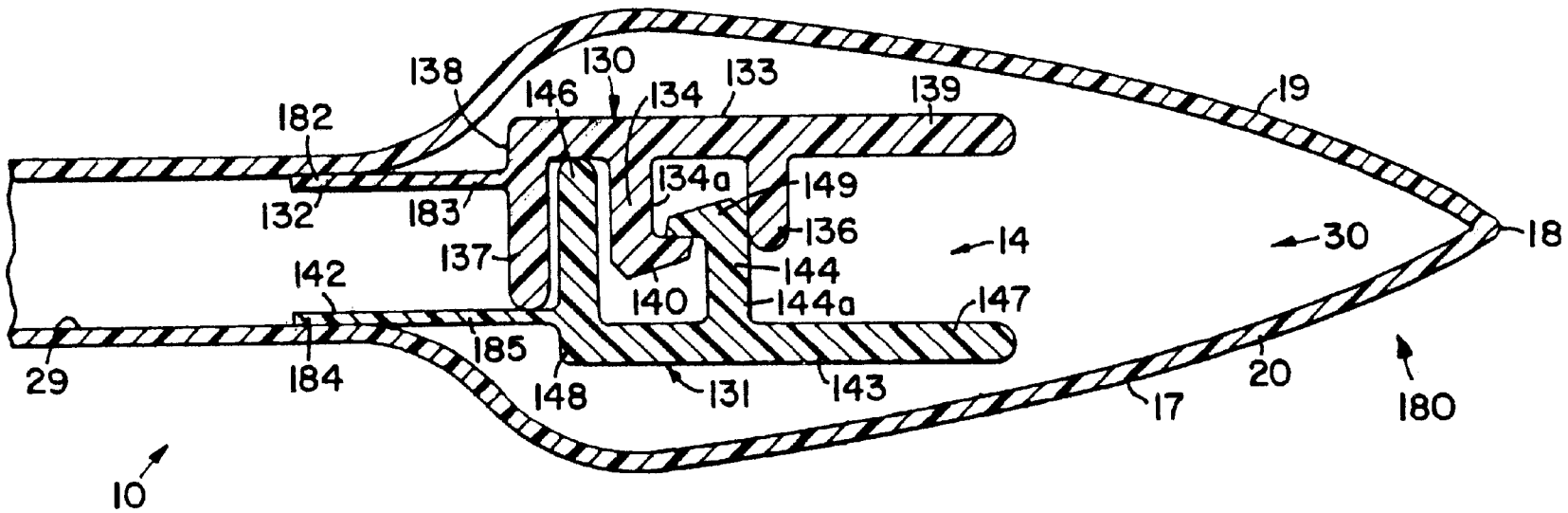
FIG. 2 is a schematic, fragmentary, cross-sectional view of the resealable package of FIG. 1, taken along line 2—2 of FIG. 1, according to selected principles of the present disclosure.

Attention is directed to FIG. 2. FIG. 2 is a schematic, fragmentary, cross-sectional view of the resealable package 10 of FIG. 1. Referring now to FIGS. 1 and 2, with some manufacturing applications, a single sheet of package film 17 is folded along a first closed edge 18 to create first and second panel sections 19, 20. The panel sections 19, 20 are heat-sealed or ultrasonically crushed along first, second, and third edges 21, 22, 24. Alternatively, two separate sheets of film, analogous to the first and second panel sections 19, 20, can be heat-sealed or ultrasonically crushed along a first closed edge, analogous to the first closed edge 18, and first, second, and third edges, analogous to the first, second, and third edges 21, 22, 24. In other alternative embodiments, the package can also have bottom or side-gussets.

In the particular embodiment illustrated in FIGS. 1 and 2, the resealable closure mechanism 14 is positioned between the first closed edge 18 and the third edge 24.

The first and second panel sections 19, 20, the first closed edge 18, and the first, second, and third edges 21, 22, 24 define a package interior 29. Access is provided to the interior 29 by opening the first closed edge 18. The first closed edge 18 can be opened by cutting the first closed edge 18 or by tearing the first closed edge 18 from the package 10. Removing the first closed edge 18 creates a mouth 30 at the first closed edge 18 of the package 10. In the particular embodiment illustrated in FIGS. 1 and 2, the mouth 30 extends the width of the package 10.

B. The First Resealable Closure Mechanism 14

Referring now to FIG. 2, the resealable closure mechanism 14 is illustrated at the mouth 30 of the flexible package 10. The resealable closure mechanism 14 can be one of a variety of closure mechanisms. In the particular embodiment illustrated in FIG. 2, the resealable closure mechanism 14 is shown in the specific form of a zipper-type closure mechanism. By the term "zipper-type closure mechanism," it is meant a structure having opposite first and second interlocking or mating closure profiles 130,131 that under the application of pressure will interlock and close a region (not shown), between the closure profiles 130, 131.

In the embodiment illustrated in FIGS. 1 and 2, the closure mechanism 14 is a single-track Closure mechanism and includes a first closure profile 130 and a second closure profile 131. By the term "single-track," it is meant one pair of interengaging profiled elements. In FIG. 2, the first and second closure profiles 130, 131 are shown in a closed configuration. By the term "closed," it is meant the first and second closure profiles 130, 131 are generally interlocked and the package 10 is substantially sealed. By the term "sealed," it is meant that generally, the resealable closure mechanism 14 substantially prevents gases from flowing into or out of the package interior 29. By the term "substantially," it is meant that the resealable closure mechanism 14 does not necessarily create a perfect seal, for example, due to imperfections in the resealable closure mechanism 14. In general, "substantially sealed" means that the package interior 29 is not significantly exhausted under small amounts of hand pressure. Alternatively stated, the arrangement is "substantially sealed" if it is adequately sealed for its intended application.

The resealable closure mechanism 14 also has an open configuration (not shown). By the term "open," it is meant the first and second closure profiles 130, 131 are at least partially not interlocked, and the package is not substantially sealed. "Partially closed" or "open" means the resealable closure mechanism 14 is in an open configuration. In the open configuration, the package interior 29 is in gas-flow communication with an exterior environment. By the term "exterior environment," it is meant the atmosphere outside of the first and second panel sections 19, 20 and the resealable closure mechanism 14.

In particular, the zipper-type closure mechanism in FIG. 2 is an illustration of one example of a closure mechanism 14. The closure mechanism 14 includes an elongated first closure profile 130 and an elongated second closure profile 131. Typically, the closure profiles 130, 131 are manufactured separately from each other.

Still in reference to FIG. 2, the preferred first closure profile 130 depicted includes a sealing flange or bonding strip 132, a base strip 133, a first closure member 134, first and second guide posts 136, 137, and an upper flange 139. The closure member 134 extends from the base strip 133 by way of a stem 134*a* and is generally projecting from the base strip 133. At a free end of the stem 134*a* (the tip of the closure member 134) is a hook or catch 140. The guide posts 136, 137 also extend from the base strip 133 and are generally projecting from the base strip 133. The guide posts 136, 137 aid in holding the closure mechanism 14 closed and in aligning the first closure profile 130 with the second closure profile 131 for interlocking. The bonding strip 132 depends or extends downward from the second guide post 137 and can be attached to a first panel section, such as the first panel section 19 of the package 10. A first shoulder 138 is defined by the intersection of the base strip 133 and the bonding strip 132. In the example illustrated, the bonding strip 132 is spaced a distance laterally from the base strip 133 to define a corner forming the shoulder 138. The upper flange 139 extends upwardly from the base strip 133 and the first guide post 136.

The preferred second closure profile 131 depicted includes a bonding strip 142, a base strip 143, a first closure member 144, a guide post 146, and an upper flange 147. The closure member 144 extends from the base strip 143 by way of a stem 144*a* and is generally projecting from the base strip 143. At a free end of the stem 144*a* (or tip of the closure member 144) is a hook or catch 149. The guide post 146 also extends from the base strip 143 and is generally projecting from the base strip 143. The guide post 146 aids in holding the closure mechanism 14 closed and aids in aligning the second closure profile 131 with the first closure profile 130 for interlocking. The bonding strip 142 depends or extends downward from the guide post 146 and can be attached to a second panel section, such as the second panel section 20 of the package 10. A shoulder 148, analogous to the shoulder 138, is formed at the corner of the bonding strip 142 and guide post 146.

In FIG. 2, the resealable closure mechanism 14 is operably positioned. By the term "operably positioned," it is meant that the first and second closure profiles 130, 131 are configured and constructed (or constructed and arranged) to engage with one another to form the resealable closure mechanism 14. The closure member 134 of the first closure profile 130 extends from the base strip 133 a first distance. The closure member 144 of the second closure profile 131 also extends from the base strip 143 a first distance, These first distances that the closure members 134, 144 extend are sufficient to allow operative mechanical engagement, or interlocking, between the first closure member 134 of the first closure profile 130 and the first closure member 144 of the second closure profile 131. In particular, the catches 140, 149 hook or engage each other.

Typically, the closure profiles 130, 131 are formed from a suitable plastic (or polymeric) material by two separate extrusions or through two separate openings of a common extrusion. In the particular embodiment illustrated in FIG. 2, the bonding strips 132, 142 of the first and second closure profiles 130, 131, respectively, are secured to the first and second panel sections 19, 20, respectively, of the package 10. Preferably, the closure profiles 130, 131 are heat-sealed to the panel sections 19, 20, respectively, of the package 10, as is well known. In alternative embodiments, the closure profiles can be secured to the panel sections by other means, such as using an adhesive.

Referring back to FIG. 1, the first closure profile 130 (FIG. 2) has first and second opposite ends 150, 151. Likewise, although not shown, the second closure profile 131 (FIG. 2) has first and second opposite ends. The first end 150 of the first closure profile 130 and the first end (not shown) of the second closure profile 131 are sealed together at the first edge 21 of the package 10. Analogously, the second end 151 of the first closure profile 130 and the second end (not shown) of the second closure profile 131 are sealed together at the second edge 22 of the package 10.

Sealing the closure profiles 130, 131 (FIG. 2) together at the first and second edges 21, 22 of the package 10 aids in aligning the closure profiles 130, 131 for interlocking. Preferably, pressure is applied to the closure profiles 130, 131 as they engage and form an openable sealed closure mechanism 14. Pulling the first closure profile 130 and the second closure profile 131 away from each other causes the two closure profiles 130, 131 to disengage, opening the package 10. This provides access to the contents of the package 10 through the mouth 30.

Typically, the resealable closure mechanism 14 is made of a polymer, plastic material, such as polyethylene or polypropylene. Typically, the resealable closure mechanism 14 illustrated in FIGS. 1 and 2 will be manufactured using conventional extrusion and heat sealing techniques. The resealable closure mechanism 14 can be any of a variety of closure mechanisms, well known or yet to be developed. For example, the resealable closure mechanism 14 can be constructed according to U.S. Pat. Nos. 4,240,241; 4,246,288; or 4,437,293; each of which is incorporated by reference herein.

In alternative embodiments, the resealable closure mechanism can be positioned at a location different than that depicted in FIG. 1, depending on the application needs for the package. In other alternative embodiments, the closure profiles can be extruded with the panel sections of the package.

C. The Slider Device 160

Referring back to FIG. 1, the package 10 also includes a slider device 160. The slider device 160 aids in opening and closing the resealable closure mechanism 14. Preferably, the slider device 160 is operably positioned. By the term "operably positioned," it is meant the slider device 160 is configured and arranged to open the resealable closure mechanism 14 when the slider device 160 is moved in a first direction A and to close the resealable closure mechanism 14 when the slider device 160 is moved in a second direction B. The slider device 160 has a separator end 161 and a pinching end 162. The separator end 161 of the slider device 160 is configured and arranged to separate the first and second closure profiles 130, 131, FIG. 2, when the slider device 160 is moved in the first direction A to open the resealable closure mechanism 14. The pinching end 162 is configured and arranged to direct the first and second closure profiles 130, 131 toward one another when the slider device 160 is moved in the second direction B, to engage the first and second closure profiles 130, 131 and close the resealable closure mechanism 14.

A notch 166 is provided in the resealable closure mechanism 14 for parking the slider device 160 when the slider device 160 is in the closed position. By the term "closed position," it is meant when the slider device 160 is moved in the second direction B and comes to rest, or "parks," in the notch 166. In this position, the package 10 is substantially sealed. In the example embodiment illustrated in FIG. 1, the notch 166 is in the form of a cutout 167. The preferred notch 166 shown includes two straight edges or sides 169, 170, generally perpendicular to each other, and a side 171 that extends at, in a preferred embodiment, an oblique angle relative to side 170. By "oblique angle", it is meant an angle that is not substantially perpendicular or straight. The side 169 preferably is generally parallel to the first edge 21, while the side 170 preferably is generally parallel to the third edge 24. The side 171 can extend at an angle relative to side 170 of at least 30 degrees, typically between about 100–150 degrees, typically no greater than about 160 degrees, and in the preferred embodiment about 135 degrees. The notch 166 serves as a "parking place" for a slider device 160 and also facilitates mounting the slider device 160 onto the resealable package 10 during initial assembly.

In addition, the side 169 closest to the first edge 21 helps to create a stop member for the slider device 160. Further, the angle that the side 171 extends helps to reduce friction between the slider device 160 and the resealable closure mechanism 14, when the slider device 160 is being moved from the notch 166 to open the closure mechanism 14. This contributes to an easier opening, more convenient package 10.

Figure 3:
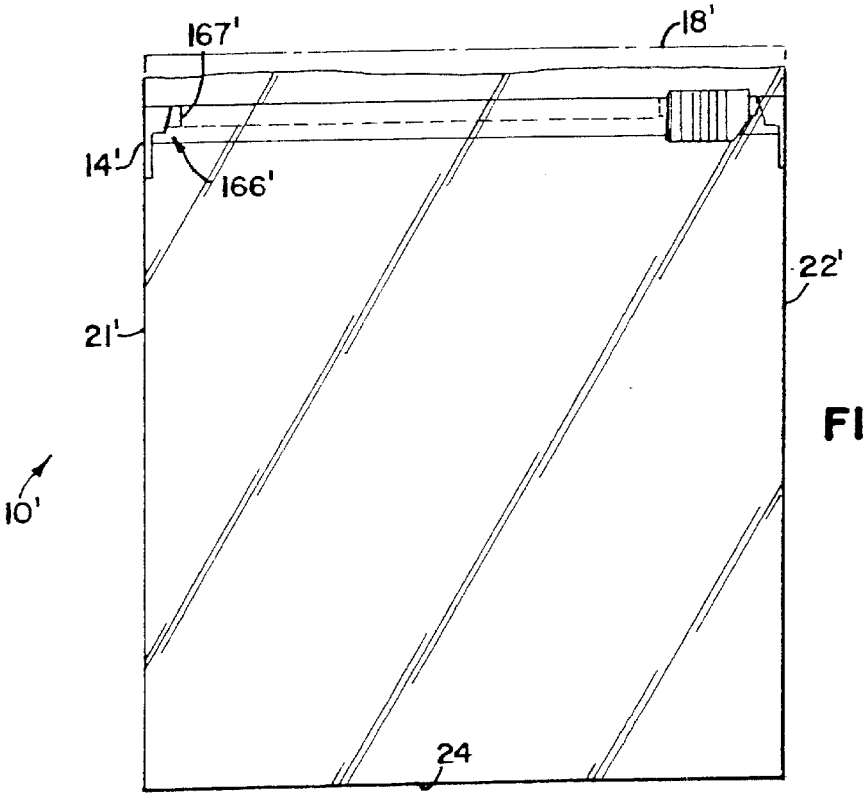
FIG. 3 is a schematic, plan view of an example embodiment of a resealable package having a slider device and a tamper-evident structure, according to selected principles of the present disclosure.

Attention is directed to FIG. 3. FIG. 3 is a schematic, plan view of an alternate embodiment of a resealable package 10'. In this example embodiment, a notch 166' is in the form a slit 167'. In other alternative embodiments, the notch can have any one of a variety of configurations, well known or yet to be developed.

Referring to FIGS. 1 and 2, the notch 166 is arranged and configured such that the separator end 161 of the slider device 160 is removed from between the first and second closure profiles 130, 131 when the slider device 160 is "parked" in the notch 166, allowing the resealable closure mechanism 14 to be substantially sealed.

Slider devices 160 and how they function to open and close resealable closure mechanisms, in general, are disclosed, for example, in U.S. Pat. Nos. 5,063,644; 5,301, 394; 5,442,837; and 5,664,229, each of which is incorporated by reference herein. Such slider devices can be adapted to applications according to principles of the present disclosure.

D. The Tamper-Evident Structure 70

Attention is directed to FIG. 2. The package 10 also includes a tamper-evident structure 180. The tamper-evident structure 180 provides an indication to the consumer as to whether the package 10 has been previously opened, or has been "tampered." The tamper-evident structure 180 can be used to provide a hermetic seal to preserve a product within the interior 29 of the package 10. By the term "hermetic seal," it is meant the package 10 is sealed to prevent the ingress or egress of undesirable levels of gases between the package interior 29 and the exterior environment.

In the example embodiment illustrated in FIGS. 1 and 2, the tamper evident structure 180 includes the first and second panel sections 19, 20 folded at the first closed edge 18 and sealed at the first, second, and third edges 21, 22, 24. A first portion 182 of the bonding strip 132 of the first closure profile 130 is secured to the first panel section 19 of the package 10. A second portion 183 of the bonding strip 132 of the first closure profile 130 remains unsecured to allow attachment and movement of the slider device 160. Likewise, a third portion 184 of the bonding strip 142 of the second closure profile 131 is secured to the second panel section 20 of the package 10. A fourth portion 185 of the bonding strip 142 of the second closure profile 131 remains unsecured to allow attachment and movement of the slider device 160. In this fashion, the tamper-evident structure 180 is provided around, and encloses, the resealable closure mechanism 14 and the slider device 160.

In order to access the interior or contents of the package 10, the tamper-evident structure 180 needs to be penetrated. The tamper-evident structure 180 will typically be penetrated by either cutting along the closed edge 18 or by tearing the closed edge 18 from the package 10, in either instance, leaving permanent evidence of opening. In some embodiments, the closed edge 18 will be scored or perforated to aid in the removal of the closed edge 18 of the tamper-evident structure 180. Once the tamper-evident structure 180 has been penetrated, the resealable closure mechanism 14 and the slider device 160 can be used to substantially reseal the package 10 and preserve the contents contained within the package interior 29.

In some embodiments, tamper-evident structures can use principles described in U.S. Pat. No. 5,713,669, incorporated by reference herein.

E. Methods of Operation

Referring to FIGS. 1 and 2, to initially open the package 10, the first closed edge 18 is cut or torn from the package 10. To open the resealable closure mechanism 14, the slider device 160 is moved in the first direction A. The separating end 161 of the slider device 160 separates the first closure profile 130 from the second closure profile 131, causing the resealable closure mechanism 14 to disengage, allowing access to the package interior 29. To reseal the package 10, the slider device 160 is moved in the second direction B. The pinching end 162 of the slider device 160 directs the first and second closure profiles 130, 131 toward one another, causing the first and second closure profiles 130, 131 to mateably engage, substantially resealing the package 10 and preserving the contents contained within the package interior 29.

F. Method of Manufacturing and Apparatus for Manufacturing

Preferably, the processes described herein utilize punching or cutting the notch 166, 166', FIGS. 1 and 3, respectively, in the first and second closure profiles 130, 131, FIG. 2, of the resealable closure mechanism 14, FIG. 2, and attaching the slider device 160, FIG. 1, to the resealable closure mechanism 14 prior to forming the package 10, FIG. 1. Preferably, the slider device 160 is carried to the packaging roll stock by way of the closure mechanism 14 and phased into register with the package 10 by sliding or moving the sliding device 160 along the closure mechanism 14 until it is in register with the "park" position. The "park position" is when the slider device 160 is resting within the notch 166. The processes described herein provide positive placement of the slider device 160 and, at the same time, allow for variability in placement of the slider device 160. An example of this advantage includes having a slider device 160 positioned on 8inch centers and manufacturing a package 10 with a width of 6 inches.

Figure 4:
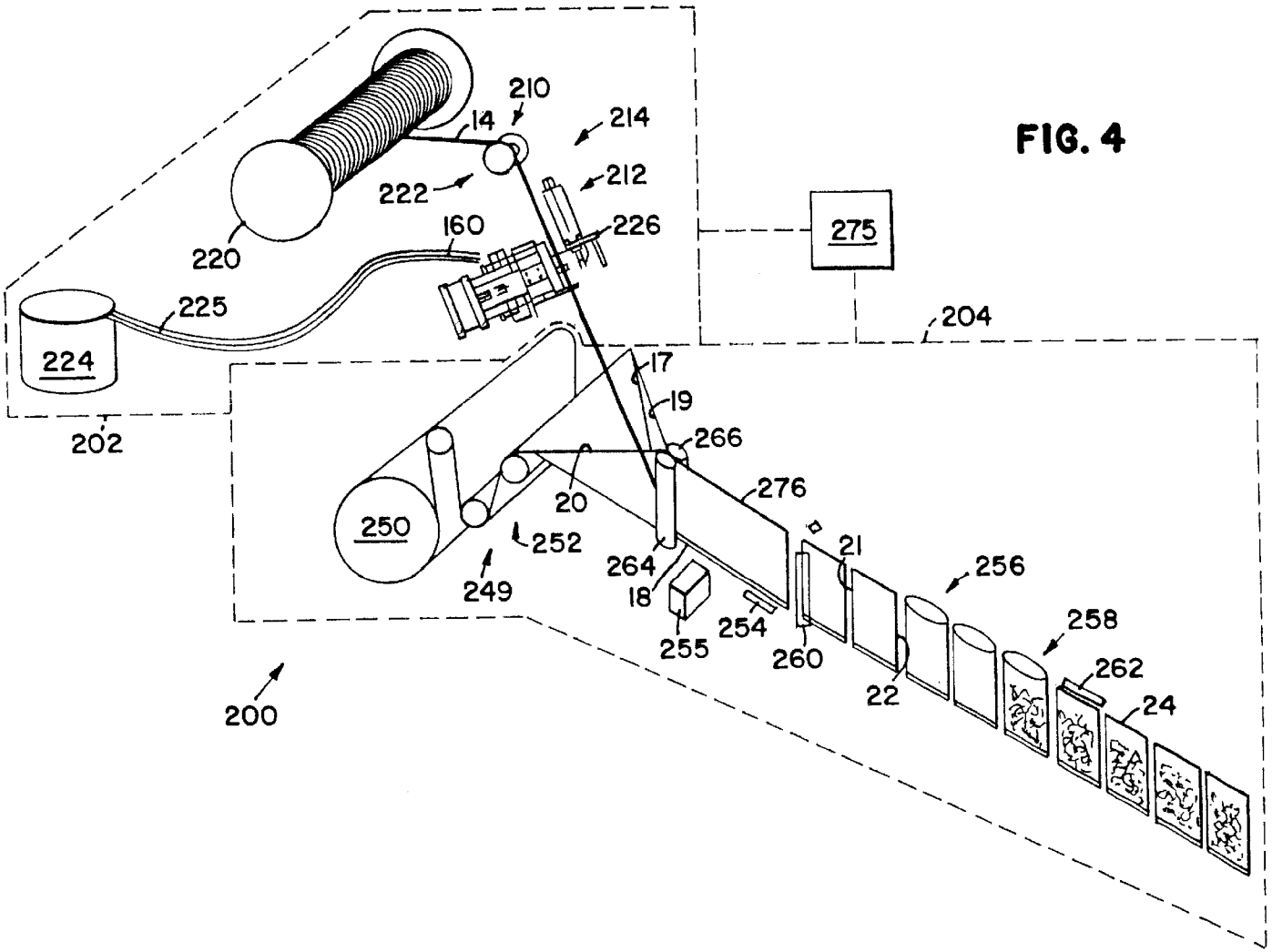
FIG. 4 is a schematic, perspective view of a first embodiment of a horizontal form, fill, and seal machine with a zipper-type closure mechanism and a slider device attachment, according to selected principles of the present disclosure.

Attention is directed to FIG. 4. FIG. 4 is a schematic, perspective view of a first example embodiment of a machine 200 for the manufacture of the resealable packages 10. Preferably, the machine 200 includes a closure mechanism feed assembly (CMA) apparatus 202 and a form, fill, and seal (FFS) apparatus 204, such as a horizontal form, fill and seal apparatus.

Preferably, the CMA apparatus 202 includes a profile applicator 210, a slider applicator 212, and a notching system 214. The profile applicator 210 includes a profile wind device 220 and a profile feed system 222. The profile wind device 220 supplies a continuous rolled, linear strip of the resealable closure mechanism 14. Typically, the resealable closure mechanism 14 is supplied with the first and second closure profiles 130, 131 interlocked as illustrated in FIG. 2. The profile feed system 222 supplies the linear supply of the resealable closure mechanism 14.

The slider applicator 212 includes a bowl feeder 224, a track 225, and a slider attachment device 226. The bowl feeder 224 supplies a continuous supply of slider devices 160. Typically, the slider devices 160 are supplied in bulk form and are oriented by way of the bowl feeder 224. The track 225 feeds the slider devices 160 to the slider attachment device 226.

The notching system 214 cuts or punches the notch 166, FIG. 1, or slit 166', FIG. 3, in the resealable closure mechanism 14, as the resealable closure mechanism 14 passes through the notching system 214 prior to attachment of the slider device 160 to the resealable closure mechanism 14. The slider attachment device 226 attaches the slider device 160 to the resealable closure mechanism 14 and phases the slider device 160 into register with the package 10 by sliding or moving the slider device 160 along the resealable closure mechanism 14 until it is in register with the "park position," or, alternatively stated, the slider device 160 is resting within the notch 166.

The assembled resealable closure mechanism 14 with the attached slider device 160 is advanced to the FFS apparatus 204 for attachment to the package 10, FIG. 1, by the FFS apparatus 204.

Preferably, the FFS apparatus 204 includes a web feed and form assembly 249 having a film wind device 250, and a film advance system 252; a profile sealer 254; a photo eye, or photo cell, 255; a forming system 256; a filling system 258; a cutting and sealing system or assembly 260; and a sealer 262.

Preferably, the film advance system 252 pulls a continuous web of package film 17 from the film wind device 250 through the film advance system 252. The film advance system 252 folds the package film 17 in half at vertical rollers 264, 266 forming the first closed edge 18, and the first and second panel sections 19, 20. The film advance system 252 draws the assembled resealable closure mechanism 14 with the attached slider device 160 between the first and second panel sections 19, 20 near the first closed edge 18.

The photocell 255 scans the package 10 to determine the location of the notches 166, FIG. 1, in the resealable closure mechanism 14 in relation to the first and second edges 21, 22 and the interval of the notches 166. Preferably, the photocell 255 sends this information regarding the location of the notches 166 to a control system 275. The control system 275 compares the information regarding the location of the notches 166 to package specifications contained within the control system 275. The control system 275 adjusts the notching system 214, and thus the location of successive notches 166, to adjust for variances between the package specifications and the location of the notches 166 as read by the photocell 255. Of course, the package specifications can be changed to vary the manufacturing depending on the application needs. In this fashion, the photocell 255, the control system 275, and the notching system 214 allow a package width to be varied and the placement of the notch 166 and slider device 160 to be adjusted accordingly and allow positive placement of the notch 166 and the slider device 160 throughout the manufacturing process.

The profile sealer 254 secures the resealable closure mechanism 14 to the panel sections 19, 20 forming a continuous combination 276. The cutting and sealing system 260 cuts the package 10 to the appropriate width and seals the first and second edges 21, 22 of the package 10. The forming system 256 opens the package 10 and forms the package 10. The filling system 258 fills the opened and formed package 10 with a product 280. The sealer 262 seals the third edge 24 to complete the package 10.

It should be noted that the control system 275 can be used to adjust other components of the machine 100 to vary the manufacturing according to different package specifications. For example, the control system 275 can be used to control the cutting and sealing apparatus 260 to vary the width the package 10 is cut by the cutting and sealing apparatus 260.

Figure 5:
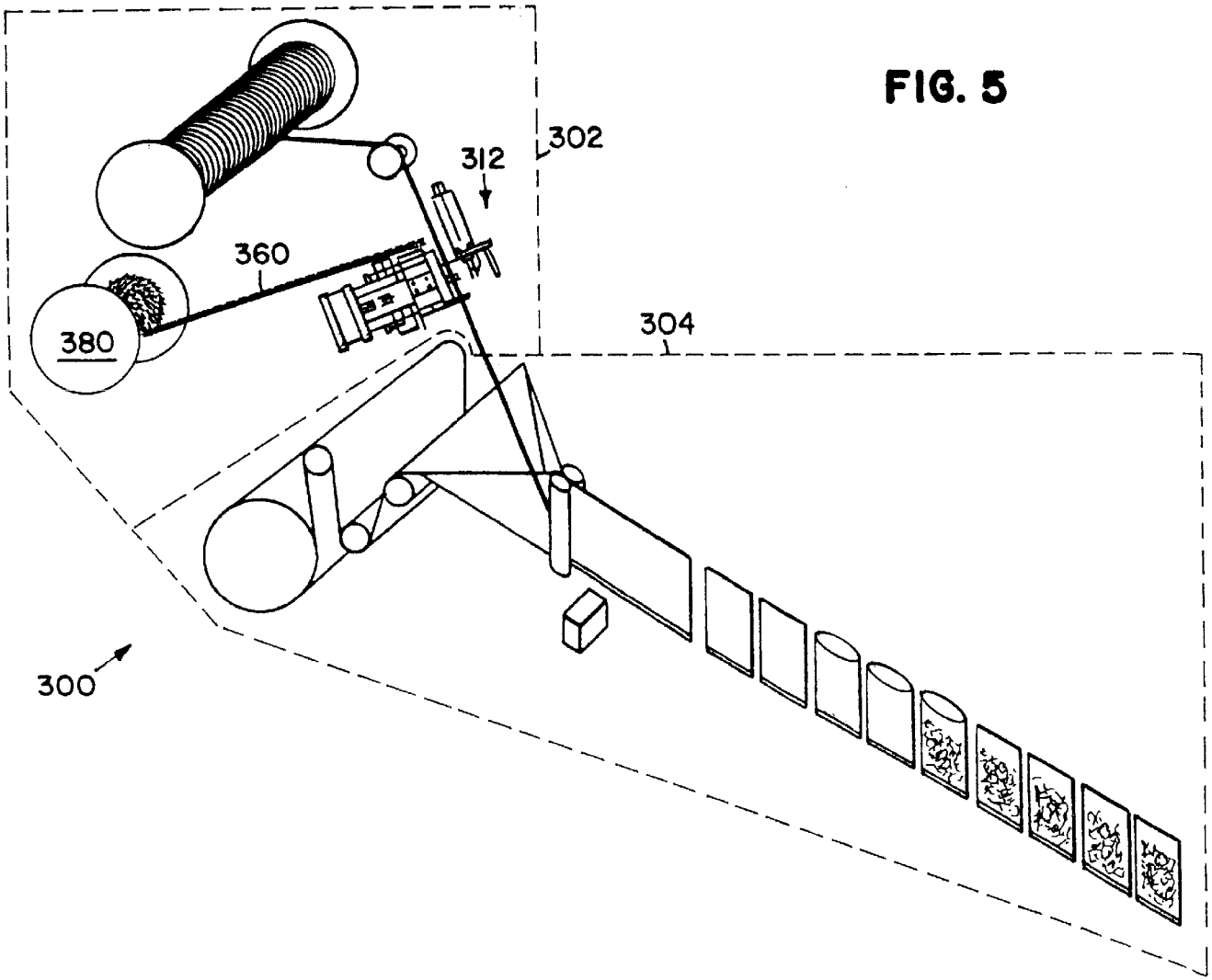
FIG. 5 is a schematic, perspective view of a second embodiment of a horizontal form, fill, and seal machine with a zipper-type closure mechanism and a slider device attachment, according to selected principles of the present disclosure.

Attention is directed to FIG. 5. FIG. 5 is a schematic, perspective view of a second embodiment of a machine 300 having a CMA apparatus 302 and a FFS apparatus 304. The embodiment illustrated in FIG. 5 is analogous to the embodiment illustrated in FIG. 4 with the exception of how the slider devices 360 are supplied. Instead of receiving the slider devices 360 in bulk form as in FIG. 4, the slider devices 360 are supplied wound on a roll 380. The slider devices 360 are unwound and fed into a slider applicator 312.

Figure 6:
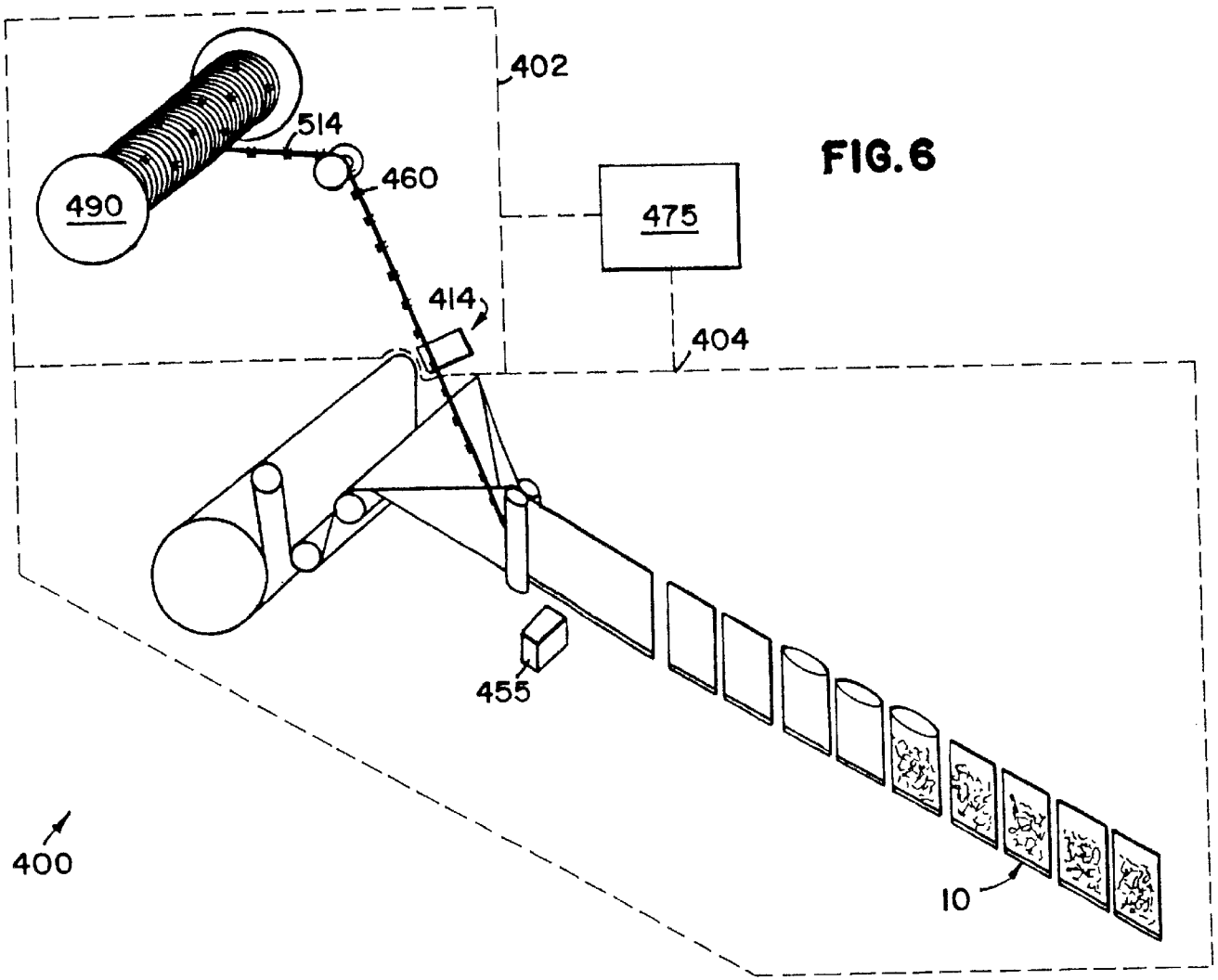
FIG. 6 is a schematic, perspective view of a third embodiment of a horizontal form, fill, ad seal machine with a zipper-type closure mechanism and a slider device attachment, according to selected principles of the present invention.

Attention is directed to FIG. 6. FIG. 6 is a schematic, perspective view of a third embodiment of a machine 400 having a CMA apparatus 402 and a FFS apparatus 404. The embodiment illustrated in FIG. 6 is analogous to the embodiment illustrated in FIG. 4 with the exception that the resealable closure mechanism 514 and the slider devices 460 are assembled together on a spool 490 prior to being fed into the notching system 414. Of course, this example embodiment does not have a slider applicator. The photocell 455 sends the information regarding the location of the notch to a control system 475 to make adjustments as necessary.

In other alternative embodiments, a vertical form, fill, and seal machine can be used in accordance with the principles described herein.

The above specification and examples are believed to provide a complete description of the manufacture and use of particular embodiments of the invention. Many embodiments of the invention can be made without departing from the spirit and scope of the invention.

What is claimed is:

1. A method of manufacturing a flexible package, the method comprising:

(a) feeding a continuous web of flexible panel material into a package forming operation;
  (i) said continuous web being configured to define first and second juxtaposed panel sections;

(b) positioning a continuous strip of resealable closure mechanism having a series of spaced slider devices thereon between the first and second panel sections of the continuous web to form a continuous combination having the first and second panel sections and the resealable closure mechanism;
  (i) the step of positioning includes:
    (A) positioning a continuous strip of resealable closure mechanism having a series of spaced notches therein;
    (B) a step of notching a plurality of spaced notches in the continuous strip of resealable closure mechanism at determined intervals;

(c) forming a plurality of flexible packages from the continuous combination;
  (i) each flexible package including:
    (A) only one slider device thereon; and,
    (B) a seal between the first and second panel sections oriented to enclose the one slider device between the first and second panel sections and the seal;
  (ii) the step of forming includes forming a plurality of flexible packages wherein each flexible package further includes only one operably positioned notch; and wherein:

(d) the step of notching a plurality of spaced notches includes notching a plurality of spaced notches at determined intervals in response to receiving a signal.

2. A method according to claim 1, wherein:

(a) the step of forming a plurality of flexible packages includes a form, fill, and seal operation.

3. A method according to claim 2, wherein:

(a) the step of forming a plurality of flexible packages includes a horizontal form, fill, and seal operation.

4. A method according to claim 1, wherein:

(a) the step of notching a plurality of spaced notches includes notching a plurality of spaced notches at determined intervals in response to receiving a signal from a control system.

5. A method according to claim 4, wherein:

(a) the step of notching a plurality of spaced notches includes a step of reading an interval between the plurality of spaced notches.

6. A method according to claim 5, wherein:

(a) the step of reading an interval includes reading an interval between the plurality of spaced notches and sending information regarding the interval to the control system.

7. A method of manufacturing a flexible package, the method comprising:

(a) feeding a continuous web of flexible panel material into a package forming operation;
  (i) said continuous web being configured to define first and second juxtaposed panel sections;

(b) positioning a continuous strip of resealable closure mechanism having a series of spaced slider devices and notches thereon between the first and second panel sections of the continuous web to form a continuous combination having the first and second panel sections and the resealable closure mechanism;

(i) the step of positioning including notching a plurality of spaced notches in the continuous strip of resealable closure mechanism at determined intervals in response to receiving a signal;

(c) forming a plurality of flexible packages from the continuous combination;

(i) each flexible package including:

(A) only one slider device thereon;

(B) a seal between the first and second panel sections oriented to enclose the one slider device between the first and second panel sections and the seal; and (C) one operably positioned notch.

8. A method according to claim 7, wherein:

(a) the step of forming a plurality of flexible packages includes a form, fill, and seal operation.

9. A method according to claim 8, wherein:

(a) the step of forming a plurality of flexible packages includes a horizontal form, fill, and seal operation.

10. A system for manufacturing a flexible package, the system comprising:

(a) a web feed and form assembly configured to feed a continuous web of flexible panel material and to form first and second juxtaposed panel sections from the continuous web of flexible panel material;

(b) a closure mechanism feed assembly configured to position a continuous strip of resealable closure mechanism having a series of spaced slider devices thereon between the first and second panel sections to form a continuous combination having the first and second panel sections and the resealable closure mechanism; and (c) a cutting and sealing assembly configured to form a plurality of flexible packages from the continuous combination in such a manner that;

(i) each flexible package includes:

(A) only one slider device thereon; and, (B) a seal between the first and second panel sections oriented to enclose the one slider device between the first and second panel sections and the seal (d) a notching system configured to notch a plurality of spaced notches in the continuous strip of resealable closure mechanism; and wherein, the notching system notches a plurality of spaced notches in the continuous strip of resealable closure mechanism in response to receiving a signal.

* * * * *